United States Patent [19]

Milo

[11] 4,170,873

[45] Oct. 16, 1979

[54] LUBRICATION SYSTEM

[75] Inventor: George T. Milo, Bridgeport, Conn.

[73] Assignee: Avco Corporation, Stratford, Conn.

[21] Appl. No.: 808,264

[22] Filed: Jul. 20, 1977

[51] Int. Cl.[2] ..... F02C 7/06
[52] U.S. Cl. ..... 60/39.08; 184/6.11
[58] Field of Search ..... 60/39.08; 184/6.11

[56] References Cited

U.S. PATENT DOCUMENTS

| | | | |
|---|---|---|---|
| 2,611,440 | 9/1952 | Haworth et al. | 60/39.08 |
| 2,827,342 | 3/1958 | Roach | 184/6.11 |

FOREIGN PATENT DOCUMENTS

| | | | |
|---|---|---|---|
| 702551 | 1/1965 | Canada | 184/6.11 |

*Primary Examiner*—Louis J. Casaregola
*Attorney, Agent, or Firm*—Ralph D. Gelling

[57] ABSTRACT

An oil supply system for pumping oil to the main shaft bearings seals, accessory gears and splines of a gas turbine engine is provided with a bypass duct controlled by a valve programmed to dump excessive oil flow at engine idle. The valve diverts oil flow from the bearings to prevent a build-up therein. A check valve is placed in the main supply line to the bearings and is designed to stop oil flow after engine shutdown.

2 Claims, 6 Drawing Figures

LUBRICATION SYSTEM

BACKGROUND OF THE INVENTION

In a gas turbine engine, the compressor and turbine are supported on a shaft which extends through the engine housing. This shaft is mounted on bearings at various locations in the engine. A lubricating system supplies these bearings with the desired amounts of oil flow.

Basically, the oil is circulated within the system by a positive displacement pump which is driven by the engine shaft. The pump, therefore, is characterized by a flow rate which varies in direct proportion to engine speed.

The bearing is mounted about the shaft within a housing which is sealed at the shaft. Oil is pumped into the housing, sprayed onto the bearing and collected at the bottom of the housing to be drained into a sump. Depending on the application, drainage can be accomplished in various ways, for example, gravity, additional pumps, or bleeding high pressure air through the shaft seals. Gravity may be used only where there is sufficient room to allow for a large drainage area to insure that all of the oil flow can be drained. However, in general, drainage is impaired by the necessity of using passages having a small cross-sectional area. Therefore in many instances, problems begin to arise as the engine speed increases and the oil flow overtakes the capability of the drainage system.

Drainage may be aided by the use of the high pressure air wich is bled from the compressor stage to pressurize the main bearing seals. This high pressure air causes a flow of air into the housing through the shaft seals, thereby increasing the pressure within the housing and creating a force to improve the flow of draining oil from the housing. This method is effective at high speeds to maintain the desired drainage flow. However, its disadvantage is that under idle or shutdown conditions, the air pressure available is substantially reduced, while the pump is still operating at relatively high flow levels. This causes an undesirable build-up of oil in the bearing package resulting in greater heat absorption in the oil. Because of the low pressure differential across the seals, oil can leak through the main shaft seal and cause oil smoking of the engine.

In order to eliminate this problem, a unique oil supply system is designated to bypass excess oil flow from the pump during idle conditions and to shut off oil flow after shut-down of the engine.

SUMMARY OF THE INVENTION

A positive displacement pump circulates oil from a sump to the accessory gears and the support bearings and splines of the shaft of a gas turbine engine. The oil drops onto the bearings and settles to the bottom of the bearing housing where it is drained and returned to the sump. In order to aid drainage, high pressure air is ducted from the compressor to the area outside of the bearing housing and is allowed to leak through the shaft seal.

This high pressure air is needed to aid scavenging during the excessive oil flow at high shaft speeds. However, at idle or shutdown condition, the amount of high pressure air available is substantially reduced while oil flow remains relatively high. In order to compensate for this deficiency during idling, a bypass duct is provided to return the excess oil flow to the sump. The orifice of the duct is designed to gradually close as the pump discharge pressure increases and to dump excessive oil flow under oil pressures corresponding to the idle condition. This same excessive oil flow condition occurs after engine shutdown and to avoid the effect thereof, a check valve is inserted in the main oil duct to shut off all oil flow when the oil pressure declines below a specific value.

DESCRIPTION OF THE DRAWING

This invention is described in more detail below with reference to the attached drawing and in said drawing.

DETAILED DESCRIPTION OF THE INVENTION

Figure 1:
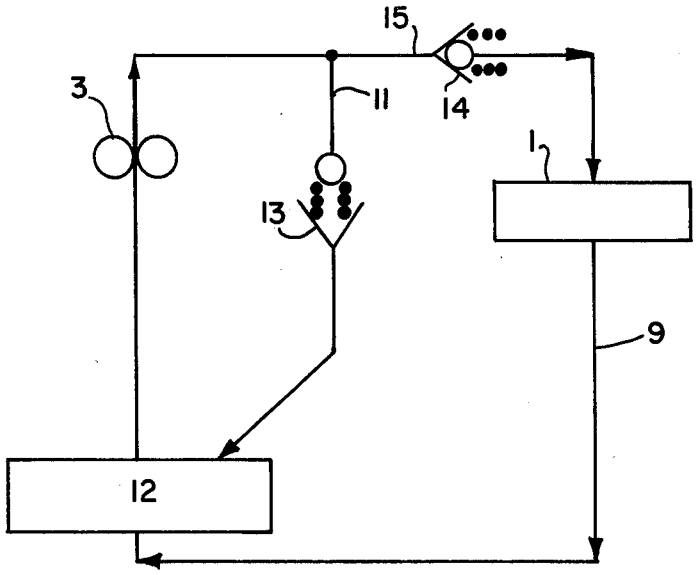
FIG. 1 is a simplified schematic flow diagram of the oil distribution system of this invention.
Figure 2:
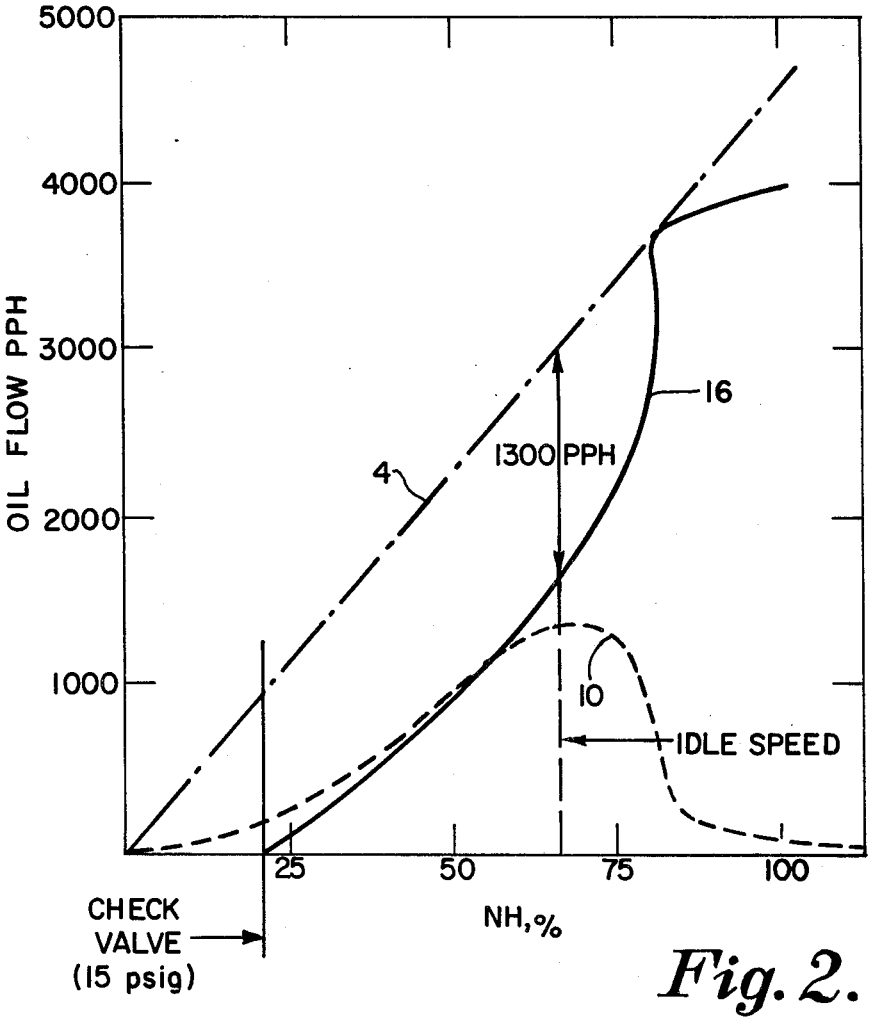
FIG. 2 is a graph showing the oil flow characteristics of a system employing this invention.

Referring to FIG. 1, a simplified oil distribution system is constructed to supply oil to the support bearing assembly 1 for the shaft 2 of a gas turbine engine. The oil is circulated within the system by a positive displacement pump 3 which is driven by the gas turbine shaft 2. The pump 3 generates an oil flow (PPH) that is directly proportional to engine speed ($N_H$) as indicated by line 4 in the graph of FIG. 2. In FIG. 2, the engine speed $N_H$ is specified as a percentage of maximum speed. It can be observed from the graph that there is a substantial oil flow at the idle condition which is approximately 70% of full capacity.

Figure 6:
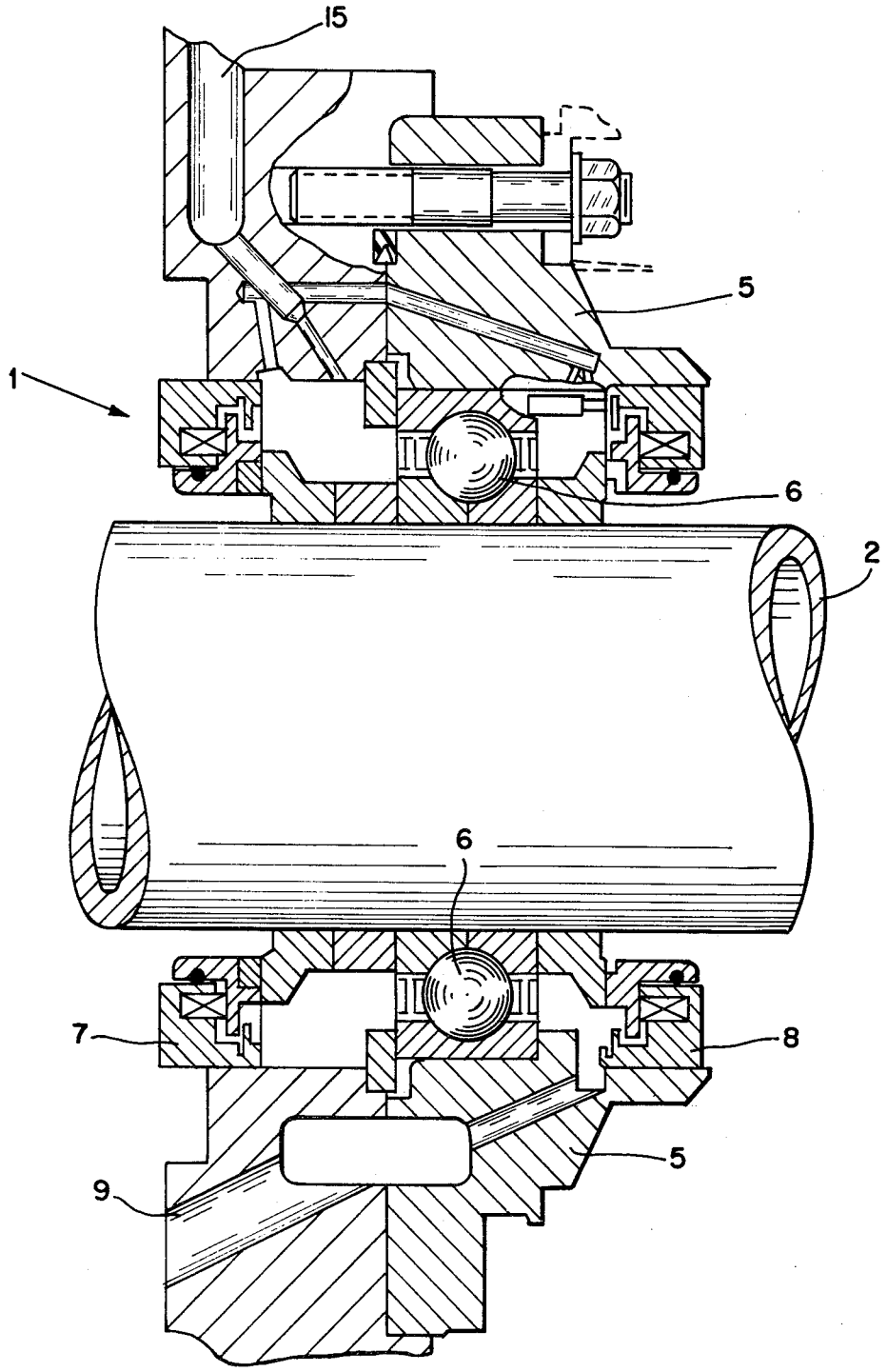
FIG. 6 is a sectional view of a bearing assembly.

As shown in FIG. 6, the bearing assembly 1 consists of a housing 5, ball bearings 6, and shaft seals 7 and 8. Oil enters housing 5 through duct 15 and drops through the bearing 6 to the lower portion of housing 5 where it collects and drains through duct 9. In order to aid the drainage of oil, high pressure air is bled from the compressor stages of the engine to the bearing assembly 1. This air flow passes through seal housing 7 and 8, and enters bearing housing cavity 5. This condition creates a positive pressure head that forces air and oil through the scavenge or drain duct 9, and thus, effectively maintains the oil level in the bearing housings at a desirable level.

A problem arises, however, when the engine is idling or when it is shut down because, during these periods, there is little or no high pressure air available to provide this function. Since the pump flow is still relatively high, oil tends to build up in the bearing because of the inability of the system to scavenge the oil from housing 5 at the necessary rate. This results in oil leaking through the shaft seals 7 and 8 and causes engine smoke.

In order to avoid this problem, a bypass duct 11, as best shown in FIG. 1, is constructed in the system to provide a return passage to the sump 12 for oil flow from pump 3. The duct 11 is controlled by a valve 13 which is constructed to be open at oil pressures representing idle speed or lower. The orifice of the valve is designed to allow the return of enough oil flow to compensate the poor scavenging capability of the oil distribution system at idle engine speeds and to supply full oil flow at higher speeds. The characteristic curve of the oil flow to the bearing with the bypass duct is shown by curve 16 in the graph of FIG. 2. The oil flow through the duct 11 is shown by curve 10 in the graph of FIG. 2.

In order to prevent an accumulation of oil during the gradually declining speeds which occur at engine shutdown, a check valve 14 is placed in the main supply line 15 from oil pump 3 at a position downstream of the bypass valve 13. The check valve 14 is designed to close at a pressure which indicates that the engine is at low compressor rotor speed. Oil from the pump 3, which flows during the later stages of engine deceleration, is returned through bypass duct 11 and a build-up within bearing housing 5 is avoided.

Figure 3:
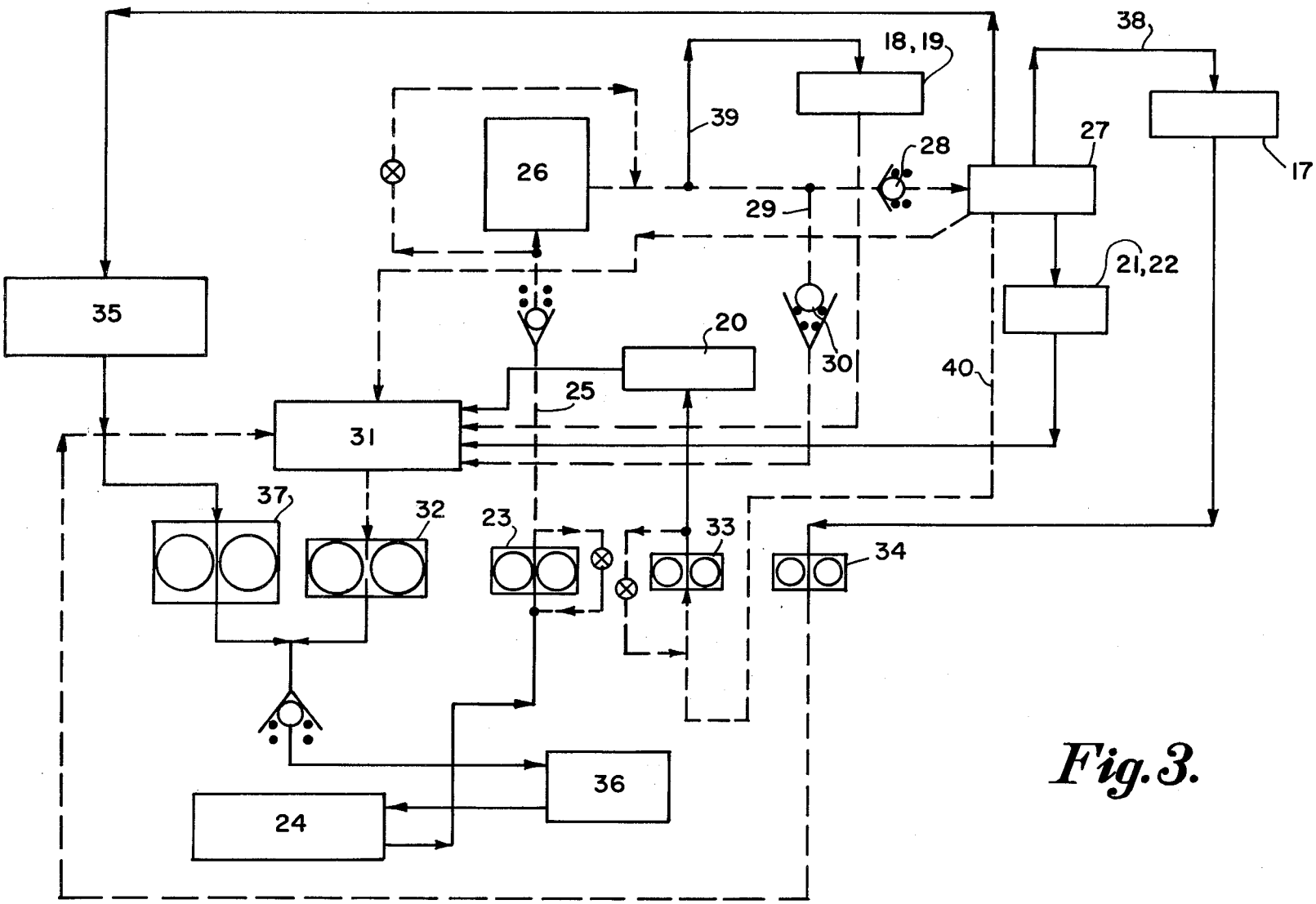
FIG. 3 is a schematic of a typical gas turbine oil supply system employing this invention.
Figure 4:
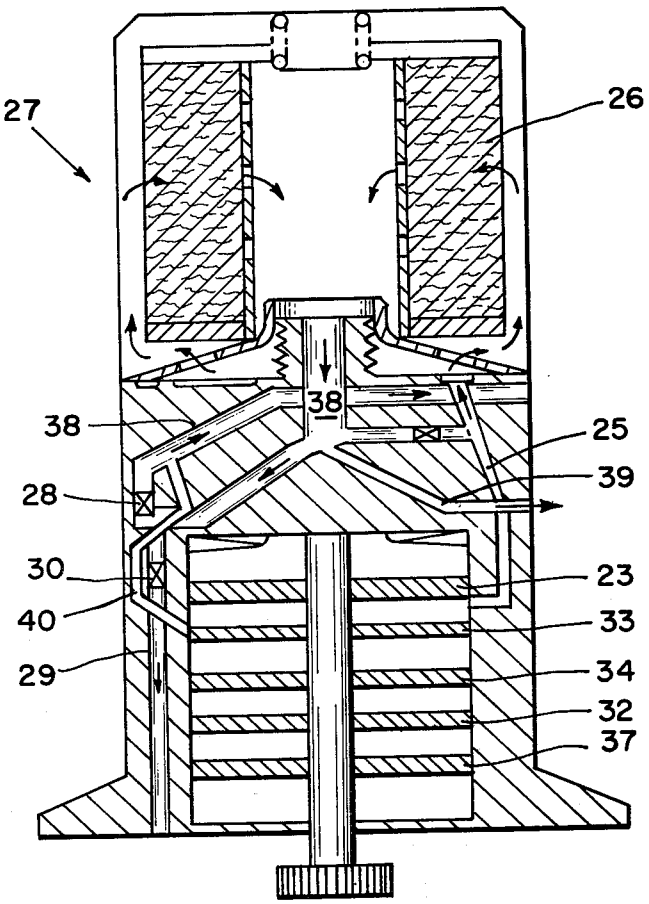
FIG. 4 is a sectional view of a manifold used in an oil supply system employing this invention.

FIG. 3 illustrates a typical gas turbine engine bearing group with its associated oil distribution system. In this instance, there are six shaft bearings, 17 through 22, located at various positions along the length of the engine shaft. Bearings 18, 19 and 21, 22 are paired and each pair is mounted in a common housing. Main pump 23 provides the basic circulating flow from sump 24 through duct 25 and filter 26. Duct 25 feeds a manifold 27 which contains the check valve 28, bypass duct 29, and control valve 30. The manifold 27 is shown in FIG. 4 and feeds the housings of bearings 17 and bearing pair 21 and 22. Scavenged oil from bearings 21 and 22 is ducted directly to the accessory gear box 31 from which it is pumped by pump 32 through the cooling unit 36 to the sump 24.

The oil flow required by each bearing varies, depending on the location and the specific bearing configuration. This sometimes requires supplementary pumps, such as 33 and 34, to maintain the desired oil flow. Pump 34 drives oil from bearing 17 to the accessory gear box 31. Manifold 27 also feeds bearing 20 through supplementary pump 33, and the scavenged oil from bearing 20 is dumped directly to accessory gear box 31. Oil flow from manifold 27 is directed to the reduction gear box 35 from which it is pumped by pump 37 through cooler 36 to the sump 24.

Because of hydraulic problems which are unique to bearing pair 18 and 19, they are fed directly by pump 23 upstream of the bypass duct 29 in order to maintain maximum oil pressure.

DESCRIPTION OF VALVE AND MANIFOLD

Manifold 27 is shown in FIG. 4 and is constructed to support filter 26 and the pump units 23, 32, 33, 34 and 37. Integrally formed within the manifold is supply duct 25 which carries the main oil flow to filter 26. The oil from the filter 26 is directed through check valve 28 to bearing 17, and bearing pair 21, 22 by duct 38. A duct 39 carries oil from duct 38 to bearing pair 18, 19 and it is connected before the bypass duct 29 to insure maximum oil pressure under all conditions. Bypass duct 29 communicates with duct 38 upstream of check valve 28 and is controlled by programming valve 30 to allow oil flow back to accessory gear box 31 under idle condition. A duct 40 feeds pump element 33 to direct oil flow to bearing 20. Bypass duct 29 may be connected as shown in FIG. 3 to direct the oil flow to the accessory gear box 31 which is scavenged by pump 32. Other ducts may be integrally formed in the manifold 27 to connect the oil flow to reduction gear housing 35 which is scavenged by pump unit 37.

Figure 5:
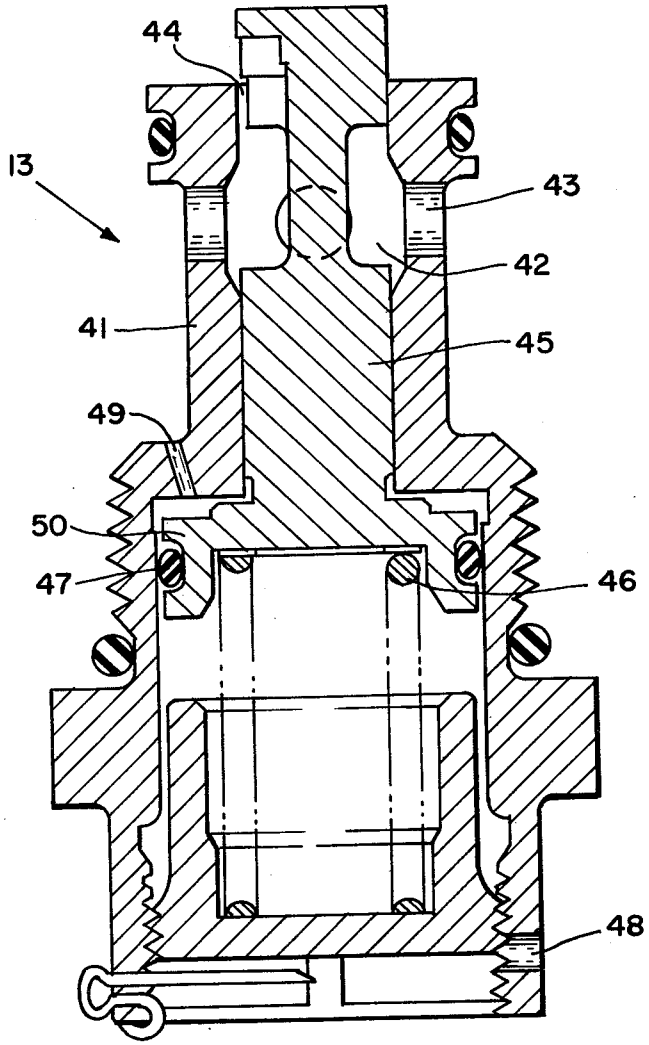
FIG. 5 is a sectional view of a valve used in the oil supply system of this invention.

The control valve 30 is best shown in FIG. 5. This valve is designed to provide a variable orifice 44 for the bypass duct 29 which gradually adjusts to allow a flow of oil in duct 29 according to curve 10 of FIG. 2 in response to the pressure in the oil supply system. Specifically, the valve 13 is designed to bypass the excess oil flow present when the engine is running at idle speed and below. Above idle speeds, the valve 30 gradually closes to provide full oil flow to the engine at high speed. The operation of valve 30 must be smooth in order to avoid any large jumps in pressure which might cause problems throughout the system.

The valve 30 consists of a valve body 41 constructed with an interior chamber 42 which has an inlet 43 and an outlet 44. Valve stem 45 is slidably mounted in chamber 42 to control the size of the outlet orifice 44. The valve stem 45 is biased in the open position by spring 46. Oil pressure from inlet 43 and secondary inlet 49 exerts a force on flange 50 of valve stem 45 to overcome the bias force of spring 46. Sliding seal 47 isolates the area of high pressure oil from the spring portion of chamber 42 which is vented to atmosphere by outlet 48.

According to the above description, the following invention is claimed as novel and is desired to be secured by Letters Patent of the United States.

I claim:

1. In a gas turbine engine, an oil supply system for the bearings which support the engine shaft comprising:

a sump for storing a quantity of bearing lubricating oil;

a manifold having integrally formed ducts connected in the oil supply system to distribute oil from the sump to the bearings, said manifold having a cavity to accommodate a pump in communication with said ducts;

a positive displacement pump driven by the engine shaft, mounted in the manifold cavity, and connected to the integrally formed ducts and the sump to discharge oil from the sump into said ducts;

a bypass duct integrally formed in the manifold to provide a bypass channel back to the sump for oil discharged from the pump;

a control valve operatively inserted in the bypass duct to control the oil flow therein, said valve having a valve body constructed with an inner chamber, said chamber having inlet and outlet orifices communicating with the bypass duct, a valve stem is mounted for movement within the inner chamber which engages the outlet orifice to vary the size thereof; said valve stem being biased to open said orifice during oil pressures indicative of engine idle speeds and to gradually close said orifice as the oil pressure indicates engine speeds increasing above idle speed; and a check valve operatively connected to the integrally formed ducts within the manifold downstream of the bypass duct to block the oil flow to the bearings during the low engine speeds which occur after engine startup and engine shutdown.

2. In a gas turbine engine an oil shaft supply system for the bearings which support the engine as described in claim 1 further comprising: means integrally formed on the manifold to receive an oil filter in communication with the lubricating oil from the sump; and an oil filter mounted on the manifold and connected to the integral ducts therein to filter the oil being directed to the bearings.

* * * * *